United States Patent [19]

Quinton

[11] 4,350,334

[45] Sep. 21, 1982

[54] CONVEYOR DEVICE FOR TRANSFERRING SHEETS BETWEEN TWO PRINTING UNITS OF A COMBINED PRINTING MACHINE

[75] Inventor: Brian M. Quinton, Basingstoke, England

[73] Assignee: De La Rue Giori S.A., Lausanne, Switzerland

[21] Appl. No.: 205,289

[22] Filed: Nov. 10, 1980

[30] Foreign Application Priority Data

Nov. 30, 1979 [CH] Switzerland ..... 10646/79

[51] Int. Cl.[3] ..... B65H 5/02

[52] U.S. Cl. ..... 271/274

[58] Field of Search ..... 271/272, 273, 274; 198/624

[56] References Cited

U.S. PATENT DOCUMENTS 3,363,816 1/1968 Maddock ..... 271/273 X 3,618,934 11/1971 Germuska ..... 271/274

*Primary Examiner*—Richard A. Schacher

*Attorney, Agent, or Firm*—James P. Malone

[57] ABSTRACT

The conveyor device comprises rollers, located side-by-side at a distance apart, whereof the axes are located in one plane and which have the same diameter. The roller at one end can be driven by the rotating inlet roller of a printing unit and all the rollers are connected to each other in pairs and preferably by an endless toothed belt respectively, so that they are driven in synchronism with the conveying speed of the printing units. The tangential plane located on the upper side of all the rollers defines the plane in which the sheets are conveyed. Located between the rollers are stationary guide plates the surfaces of which are located in the conveying plane. Mounted above each roller are pressure rollers, which are each provided on their periphery with a rubber ring and which are pressed by springs against the rollers.

This conveyor device for sheets to be installed between two printing units is particularly suitable for sheets having a small format, which are already cut to their final format.

4 Claims, 2 Drawing Figures

Figure 1:
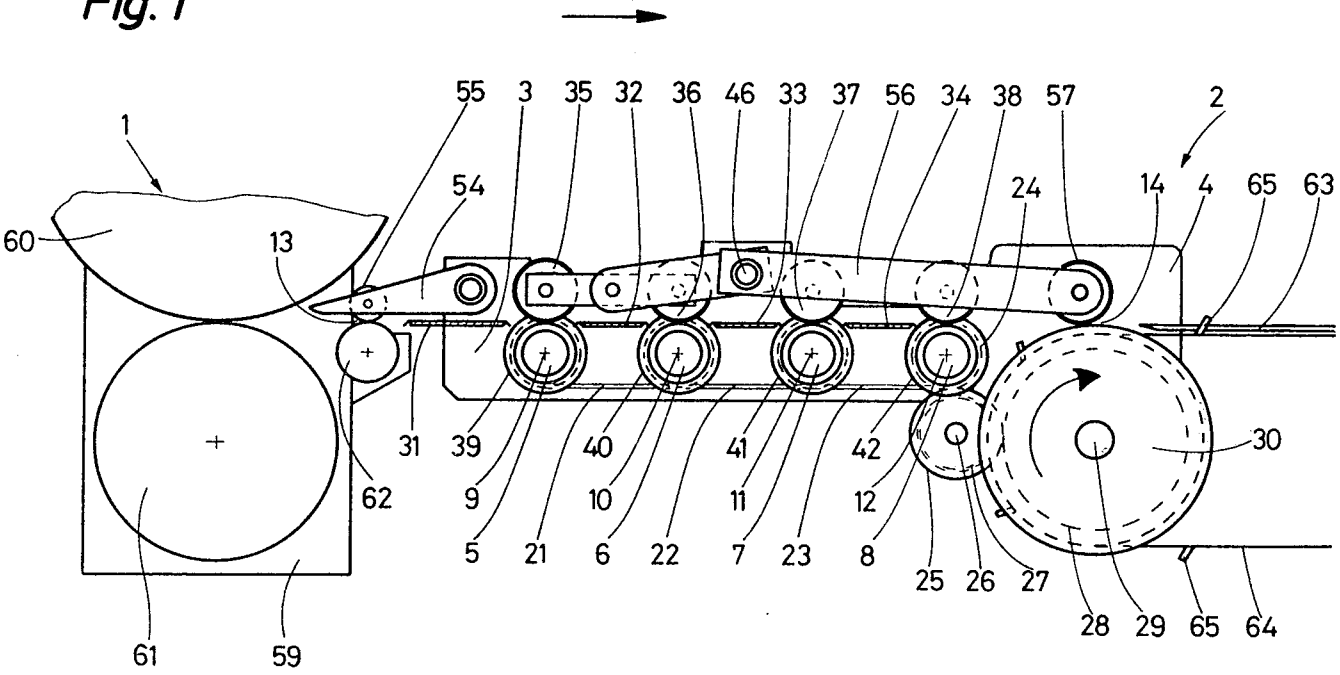

CONVEYOR DEVICE FOR TRANSFERRING SHEETS BETWEEN TWO PRINTING UNITS OF A COMBINED PRINTING MACHINE

The invention relates to a conveyor device for transferring sheets between two printing units of a combined printing machine, in particular a combined colour printing machine, with rollers conveying the sheets.

Automatically operating devices for conveying sheets between the printing units of a colour printing machine or a combined rotary printing machine are already known for the purpose of transferring the sheets in register from the first printing unit to the second printing unit. The latter are generally chain gripper systems, in which grippers attached to a conveyor chain engage the front edges of the sheets. A chain gripper system of this type is contained in the combination printing machine using engraved steel plates, which operates with two printing units using engraved plates, arranged one behind the other, which is described in Swiss Patent Specification No. 480 175 in the name of the same applicant.

U.S. Pat. No. 4,056,056 in the name of the same applicant also describes a combination printing machine consisting of an offset printing unit and a subsequent printing unit using engraved plates, in which machine the sheets are conveyed from the first printing unit to the second printing unit either likewise using a chain gripper system or however with the assistance of conveyor rollers rolling one against the other. In the case of the conveyor device using rollers, the rollers are equipped with grippers, which engage a sheet at the time of transfer and entrain the latter during part of the rotation of the rollers, the sheet being supported at least partly on the periphery of the roller.

In certain cases, particularly when the sheets have a small format and/or the distance to be covered between the two printing units is only relatively small, chain gripper systems or conveying rollers with grippers are nevertheless unsuitable or too complicated and too expensive.

For printing sheets having a small format, such as documents, securities, prospectuses, envelopes or other printed documents already cut to format with a maximum A4 size, it is known to use a printing machine operating without sheet grippers, in which the sheets are inserted by pushing fingers engaging the rear edge of the sheet in the gap between the plate cylinder and printing cylinder and, without following the rotation of the cylinder are moved through the printing gap substantially in a straight line by the printing unit cylinders. The sheets to be introduced into the printing unit thus slide on a supply table with longitudinal slots, through which project the pushing fingers attached to a moving chain installed below the table.

Frequently, sheets of this type must pass through two or more printing units, above all if after printing a basic pattern or text, marks or consecutive numbers have to be produced in a second printing operation or if colour printing is to be carried out in two printing operations. In these cases, in order to convey the sheets emerging from the printing gap of the first printing unit to the second printing unit, a conveyor device operating with grippers, which is used generally only for conveying sheets having a large format and which are subsequently to be cut to format, would be unsuitable and uneconomical.

The object of the invention is to provide a conveyor device of the afore-mentioned type, which is constructed and can be installed more simply and economically than known conveyor apparatus operating with sheet grippers and which preferably, but not exclusively, is suitable for conveying sheets having a small format of a maximum A4 size and is intended for incorporation in combined printing units, whereof the first printing unit operates in known manner, without sheet grippers, namely with pushing fingers supplying the sheets.

To solve this problem, the conveyor device according to the invention is characterised by the fact that the rollers are mounted in a frame located between two printing units, at a distance apart and side by side, lying with their axes in one plane, which rollers have the same diameter and are connected both to each other as well as to a rotating cylinder of one of the printing units so that all rollers are driven in synchronism with the conveying speed of the printing units, that the tangential plane located on the upper side of all the rollers defines the plane in which the sheets are conveyed, which plane extends between the outlet point of the first printing unit and the inlet point of the second printing unit, that stationary guide plates are mounted between the rollers, whereof the surface lies in the plane in which the sheets are conveyed and that pressure rollers are mounted above each roller, which pressure rollers are pressed by a resilient force against the rollers and come into contact with the latter at least approximately in the plane in which the sheets are conveyed.

The advantages of the conveyor device according to the invention consist essentially in that it is constructed in a simple manner and so that it is not susceptible to disturbances and can be easily adapted to any desired or necessary conveying length by selecting the number of rollers.

Although in general in the conveyor device according to the invention, the sheets are in practice moved without slipping and therefore in register, a transfer movement of the sheets which keeps them strictly in register then has no function, if the second printing unit is equipped with a known sheet feeding apparatus controlled in register or with pushing fingers moved in register, which receive the sheets at the outlet of the conveyor device. Since, in these cases, the exact register in the second printing unit is achieved by the sheet supply device controlled in synchronism with the printing unit cylinders, keeping the sheets in exact register as they are transferred to the second printing unit is not absolutely necessary. The two printing units may be of the same type, i.e. for example letterpress printing units, or even of a different type, in which case one may be a letterpress printing unit or a numbering printing unit for example and the other may be an offset printing unit.

Further features of the invention will become apparent from the sub-claims.

Figure 2:
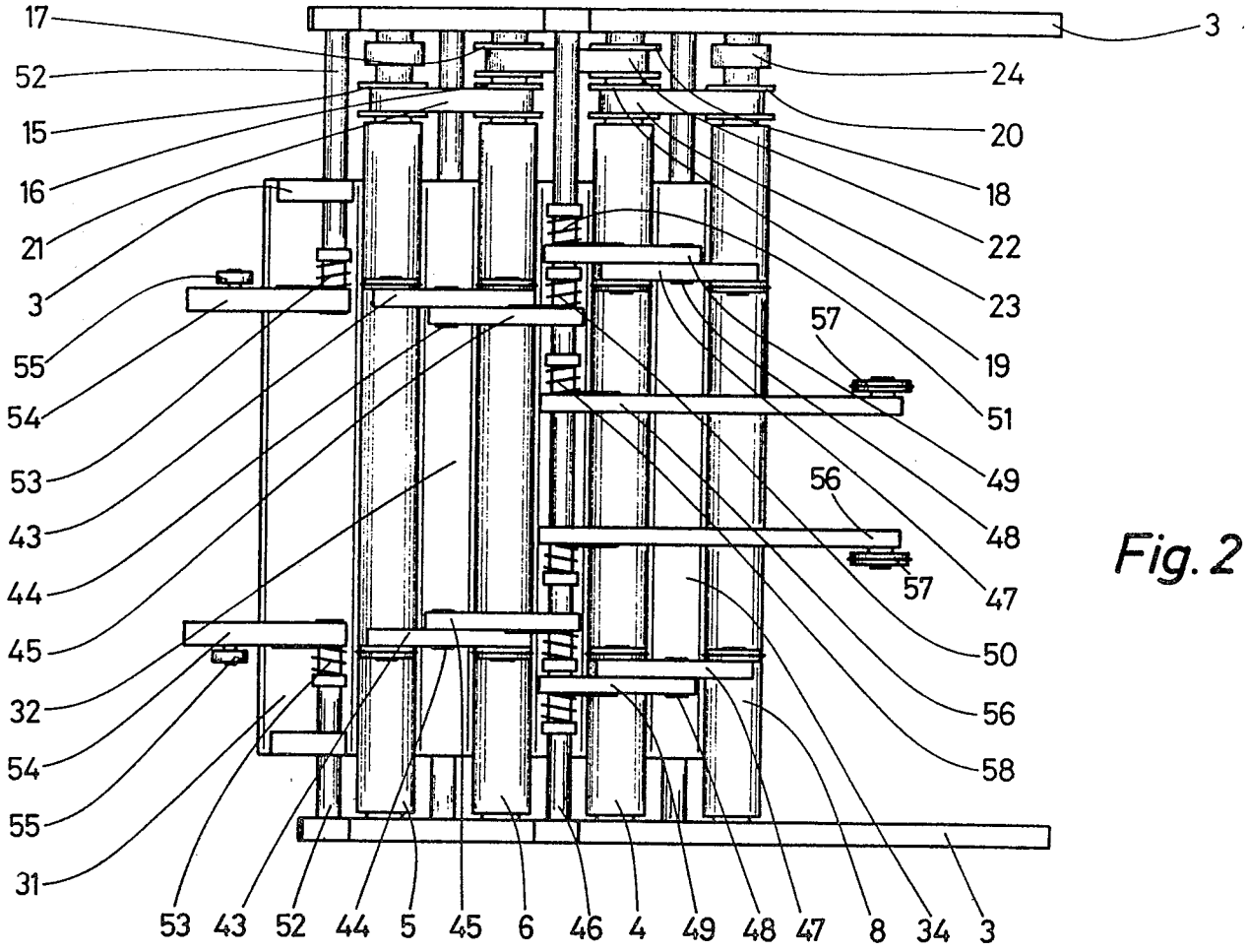

One embodiment of the invention is illustrated in detail in the drawings, in which:

FIG. 1 is a side view of a conveyor device according to the invention, partly in section, in which case the first and second printing units are shown only diagrammatically and FIG. 2 is a plan view of the conveyor device according to FIG. 1, to a smaller scale, omitting the printing units.

Mounted between a first printing unit 1 and a second printing unit 2 of a combined printing machine is a frame 3 which is attached to the housing 4 of the printing unit 2.

In the example under consideration, the printing unit 1 illustrated solely in outline in FIG. 1 is a letterpress printing unit operating without sheet grippers, of which the frame 59, the plate cylinder 60, the printing cylinder 61 co-operating therewith and an outlet roller 62 likewise mounted in the frame 59 are shown, which roller 62 is driven in synchronism with the printing unit cylinders 60 and 61. Two pressure rollers 55 belonging to the conveyor device bear on the outlet roller 62. The gap between the outlet roller 62 and pressure rollers 55 is referred to hereafter as the outlet point 13 of the first printing unit.

On a supply table (not shown), which is located at the left of the printing unit 1 in FIG. 1, the sheets to be printed are moved by pushing fingers engaging the rear edge of the sheet and inserted by their front edge in the printing gap between the plate cylinder 60 and printing cylinder 61, where they are then entrained by these cylinders during the printing operation. As indicated for the second printing unit 2 to be described hereafter, the pushing fingers are attached to a chain moved in synchronism with the printing unit cylinders, which is mounted below the supply table and project through corresponding longitudinal slots in this table. The pushing fingers projecting in this way above the plane of the table thus push the sheet forwards, which slides on the supply table. A supply arrangement of this type is known.

FIG. 1 shows only the following parts of the printing unit 2, which may be an offset printing unit likewise operating without sheet grippers, namely the frame 4, the inlet roller 30 on the shaft 29, which roller is provided with rubber on its periphery, the supply table 63 and the pushing fingers 65 attached to a moving chain 64. The inlet roller 30, which co-operates with pressure rollers 57 belonging to the conveyor device and the chain 64 are driven in synchronism with the printing unit cylinders (not shown) of the printing unit 2. The gap between the inlet roller 30 and the pressure rollers 57 will be referred to hereafter as the inlet point 14 of the second printing unit 2.

Four rollers 5, 6, 7, and 8 of the same diameter are mounted to rotate in the frame 3 for conveying the sheets from the printing unit 1 to the printing unit 2. The axes of rotation 9, 10, 11, 12 of these rollers lie in one plane and the plane located parallel thereto which is in contact with the highest points of all the rollers defines the plane in which the sheets are conveyed, which extends from the outlet point 13 of the printing unit 1 to the inlet point 14 of the printing unit 2.

All the rollers 5, 6, 7 and 8 are connected to each other in pairs by endless toothed belts, so that they rotate in synchronism at the same speed. The two rollers 5 and 6 are interconnected by a toothed belt 21, which travels over the pulleys 15, 16 attached to the roller shafts. The two rollers 6 and 7 are interconnected by a toothed belt 22, which travels over a further pulley 17 attached to the shaft of the roller 6 and a pulley 18 attached to the shaft of the roller 7 and the rollers 7 and 8 are interconnected by a toothed belt 23, which travels over a further pulley 19 attached to the shaft of the roller 7 and the pulley 20 attached to the shaft of the roller 8. Seated on the shaft of the roller 8 is a gear wheel 24, which meshes with a gear wheel 25, seated on the shaft 26 of which is a further gear wheel 27, which in turn meshes with a gear wheel 28 on the shaft 29 of the driven inlet roller 30 of the printing unit 2. The dimensions of the gearing consisting of the afore-mentioned gear wheels 24, 25, 27 and 28 are such that the rotating inlet roller 30 drives the roller 8 and thus the other rollers 7, 6 and 5 at a speed which corresponds to the linear speed at which the sheets are conveyed in the two printing units.

In front of the first roller 5, seen in the direction in which the sheets are conveyed according to the arrow in FIG. 1 and between two adjacent rollers 5, 6 or 6, 7 or 7, 8, guide plates 31, 32, 33, 34 are attached to the frame 3, the upper sides of which plates lie in the aforementioned conveying plane and on which the sheets are able to slide between the individual rollers.

Located above each of the rollers 5, 6, 7, 8 is a pair of pressure rollers 35, 36, 37, 38, which are pressed resiliently against the respective roller and come into contact with the latter in the conveying plane or at least approximately in the conveying plane. The two pressure rollers associated with each roller are located at an axial distance apart, above the central region of the rollers and are each provided on their periphery with a rubber ring 39, 40, 41, 42, which guarantees that the sheets are pressed against the rollers carefully yet reliably, so that slipping of the sheets relative to the rollers is virtually excluded. According to FIG. 2, one of the pressure rollers 35 and 36 respectively of the two pairs of pressure rollers, which co-operate with the rollers 5 and 6, is mounted at the end of a pivoting arm 43, which is pivoted at its centre by means of a pin 44 to the end of a further arm 45. At their other end, the two arms 45 are in turn mounted to rotate on a rod or shaft 46, which extends at a distance above the rollers parallel to their axes of rotation and is attached by both ends to the frame 3. In a similar manner, one of the pressure rollers 37 and 38 respectively of the two pairs of pressure rollers, which co-operate with the rollers 7 and 8, is mounted to rotate at the ends of an arm 47, which is pivoted at its centre by means of a pin 48 to the end of one arm 49 respectively. The two arms 49 are in turn likewise mounted to rotate by their other end on the shaft 46, at an axial distance from the arms 45. Each of the arms 45 or 49 is subject to the action of a helical spring 50 or 51, which pushes these arms with the arms 43 or 47 connected thereto, downwards and thus pushes the pressure rollers 35, 36 or 37, 38 against the respective rollers 5, 6 or 7, 8.

Furthermore, in the central region of the shaft 46, two further arms 56 are pivotally connected, which support the afore-mentioned pressure rollers 57 co-operating with the inlet roller 30 of the printing unit 2 and are of a suitable length. A compression spring 58 respectively presses the respective arm 56 downwards and thus presses the pressure rollers 57 against the inlet roller 30. All six helical springs 50, 51 and 58 acting as torsion springs surround the shaft 46 and are attached by one end thereof to this shaft, whereas their other end acts on the respective arm 45, 49 or 56.

The pressure rollers 55 co-operating with the outlet roller 62 of the printing unit 1 are each seated at the end of an arm 54 respectively, which is pivoted to a rod 52 attached to the frame 3 and is subject to the action of a helical spring 53 surrounding the rod 52, so that the pressure rollers 55 are pressed resiliently against the outlet roller 62.

The sheets leaving the printing unit 1 are pushed between the outlet roller 62 and the pressure rollers 55, entrained by the outlet roller 62 and then engaged successively by the rollers 5, 6, 7 and 8 and finally by the inlet roller 30 of the printing unit 2 and the respective pressure rollers 35, 36, 37, 38 or 57, due to which the sheets are moved continuously at the linear conveying speed of the printing units. Between the rollers, the sheets slide on the guide plates 31, 32, 33 or 34. Naturally, the gap between adjacent rollers must be less than the length of the sheets in the conveying direction. For the conveyor device illustrated, the minimum dimension of the sheets to be conveyed in the conveying direction is 50 mm. The gap between adjacent rollers 5, 6, 7, 8, which in the example under consideration have a diameter of approximately 20 mm, therefore amounts to approximately 40 mm.

After the sheets have passed the inlet point 14 of the printing unit 2, i.e. the inlet roller 30 with its pressure rollers 57, they reach the supply table 63 of the printing unit 2, which table is shown only diagrammatically in FIG. 1 and which operates without sheet grippers like the printing unit 1. At this point the sheets are engaged at their rear edge by pushing fingers 65, which are attached to a chain 64 mounted below the supply table 63 and project through corresponding longitudinal slots in the supply table 63. The chain 64 travels over a chain wheel seated on the shaft 29 of the inlet roller 30 and is therefore driven in register together with the inlet roller 30. The pushing fingers 65 push the sheets into the printing gap of the printing unit cylinders which are not shown. Transferring the sheets in exact register in the afore-described conveyor device is not of great significance, since the register is guaranteed in the printing unit 2 by the corresponding control of the pushing fingers.

In order to ensure that the successive sheets reach the supply table 63 promptly after passing the inlet roller 30, that they are engaged correctly by the pushing fingers 65 projecting beyond the plane of the table at the upper point of the chain wheel, the sequence of movement is adjusted so that on the conveyor device the sheets precede somewhat the register rhythm of the printing unit 2 and therefor may come to a standstill for a short time on the supply table 63, before they are moved on in register by the pushing fingers.

The printing unit 2 may naturally also be provided with a conventional sheet feeding apparatus with sheet grippers or with a chain gripper arrangement receiving the sheets.

The invention is not restricted to the embodiment described, but may have many variations as regards the number of rollers and their drives, the construction and assembly of the spring loaded pressure rollers as well as the method and manner in which the sheets are introduced into the conveyor device and supplied by the conveyor device to the second printing unit. Thus, for example, the arms 54 and 56 with the pressure rollers 55, 57 do not need to belong to the conveyor device, but may be parts of the first or second printing unit. Furthermore, the gear wheels of the roller drive may be replaced by belts or toothed belts.

What is claimed is:

1. A conveyor device for use in transferring sheets to be printed between two printing units of a combined printing machine, the device comprising a frame for location between the two printing units, parallel spaced conveying rollers of the same diameter carried by the frame and having their axes of rotation lying in a common plane with their peripheries passing through a tangential plane parallel with said common plane and constituting a plane along which the sheets pass between the outlet of one printing unit and the inlet of the other, means for driving the conveying rollers in synchronism with the conveying speed of a cylinder of one of the printing units, stationary guide plates mounted between the conveying rollers with their surfaces lying in the plane along which the sheets pass, pressure rollers mounted above each conveying roller, and means for resiliently urging the pressure rollers into contact with the conveying rollers at least approximately in the plane along which the sheets are conveyed, the pressure rollers being mounted on arms pivotable about shafts arranged parallel to the axes of the conveying rollers and are subjected to the force of springs acting at right angles to the plane along which the sheets are conveyed, the pressure rollers being arranged side-by-side and cooperating with a respective pair of conveying rollers mounted at the ends of an arm, which at its central region is pivoted by means of a pin to one end of a further arm, and which at its other end is pivotable about a stationary pivot and is subject to the action of one of the springs.

2. A conveyor device according to claim 1 in which the pressure rollers are provided on their peripheries with rubber rings.

3. A conveyor device according to claim 1, in which one of the conveying rollers is adapted to be driven via gearing from the rotatable cylinder of the printing unit with the conveying rollers being connected to each other in respective pairs by endless transmission belts.

4. A conveyor device according to claim 1 comprising, in the direction of sheet movement, spring-loaded pressure rollers spaced from the conveying rollers upstream and downstream of the latter, which pressure rollers are arranged so that they are respectively urged at least approximately in the plane along which the sheets are conveyed against a driven outlet roller of the first printing unit and a driven inlet roller of the second printing unit.

* * * * *